US006836258B2

(12) United States Patent
Best et al.

(10) Patent No.: US 6,836,258 B2
(45) Date of Patent: Dec. 28, 2004

(54) COMPLEMENTARY DUAL ANTENNA SYSTEM

(75) Inventors: Timothy E. Best, Ottawa (CA); Peter C. Strickland, Ottawa (CA)

(73) Assignee: EMS Technologies Canada, Ltd., Ottawa (CA)

( * ) Notice: Subject to any disclaimer, the term of this patent is extended or adjusted under 35 U.S.C. 154(b) by 17 days.

(21) Appl. No.: 10/301,692

(22) Filed: Nov. 22, 2002

(65) Prior Publication Data

US 2004/0100418 A1 May 27, 2004

(51) Int. Cl.[7] ..... H01Q 15/02; H01Q 21/26
(52) U.S. Cl. ..... 343/909; 343/797
(58) Field of Search ..... 343/909, 872, 343/781 P, 781 CA, 767, 770, 797; H01Q 15/02

(56) References Cited

U.S. PATENT DOCUMENTS

| | | | | |
|---|---|---|---|---|
| 3,842,421 A | | 10/1974 | Rootsey et al. | 343/909 |
| 3,975,738 A | | 8/1976 | Pelton et al. | 343/872 |
| 4,001,836 A | | 1/1977 | Archer et al. | 343/756 |
| 4,851,858 A | | 7/1989 | Frisch | 343/779 |
| 5,373,302 A | | 12/1994 | Wu | 343/781 |
| 5,512,901 A | | 4/1996 | Chen et al. | 342/175 |
| 5,949,387 A | * | 9/1999 | Wu et al. | 343/909 |
| 5,982,339 A | | 11/1999 | Lalezari et al. | 343/872 |
| 6,133,878 A | | 10/2000 | Lee | 343/700 |
| 6,147,572 A | * | 11/2000 | Kaminski et al. | 333/134 |

FOREIGN PATENT DOCUMENTS

| | | | |
|---|---|---|---|
| EP | 0 345 768 | 8/1989 | H01Q/25/00 |
| EP | 1 006 603 A1 | 2/1999 | H01P/1/205 |
| WO | WO 00/57514 | 9/2000 | H01Q/21/30 |

* cited by examiner

*Primary Examiner*—Don Wong
*Assistant Examiner*—Trinh Vo Dinh
(74) *Attorney, Agent, or Firm*—Shapiro Cohen

(57) ABSTRACT

The present invention provides a dual antenna system where a first antenna element has a metallic surface with openings that are resonant at frequencies other than the operating frequency of a second antenna element. The openings are sized such that the metallic components are relatively transparent at and near resonant frequencies of those openings. According to the present invention, the resonant frequencies of the openings may be the transmitting or receiving frequencies of the second antenna element, or of nearby antennas.

7 Claims, 4 Drawing Sheets

COMPLEMENTARY DUAL ANTENNA SYSTEM

FIELD OF THE INVENTION

The present invention relates to the design of an antenna system including both a band-pass antenna and a band-reject antenna. More particularly, this invention relates to two independently steered antennas which are closely spaced, one antenna being band-pass and the other antenna being band-reject.

BACKGROUND TO THE INVENTION

The design of microwave antennas for use in congested environments such as in the top of the stabilizer of an aircraft, places stringent limitations on the location of the antennas. Furthermore, it is often necessary to pack several antennas into a small area and consequently the antennas tend to be close together. This close proximity of the antennas can cause interference and unwanted reflections distorting the patterns of the antennas.

In order to compensate for the unwanted effects of antennas in close proximity, dichroic or frequency sensitive surface (FSS) reflectors are commonly selected to form part of an antenna which is in close proximity to one or more other antennas. In such reflective antenna structures it is possible to design antenna reflectors, that will pass signals of one frequency band and reflect signals of other frequencies. An FSS is designed such that it selectively transmits some wavelengths of radiation and reflects others. The FSS can thus enable the separation of two bands, such as the Ka and Ku bands or L and Ku bands.

The reflectors are normally made up of a large array of resonant elements, known as resonators. These resonators may be dipoles, of various configurations. The dipoles reflect certain frequencies while the FSS also transmits the other frequencies. Based on the relative size of the dipoles, in relation to the wavelength, the reflection and transmission of frequencies is altered. Proper sizing of the dipoles will then determine the frequencies reflected while other frequencies are transmitted.

The dipole resonators are grouped into a grid formation on an antenna reflector to form a frequency-sensitive surface. The spacing between the resonator elements is an important design constraint in differentiating the reflected and transmitted bands and can strongly influence the bandwidth of she rejection band.

In the prior art, U.S. Pat. No. 3,842,421, issued to Rootsey, discloses an antenna having a reflective surface with an array of apertures. The apertures have a resonant character independent of polarization. The reflective surface itself is thereby transmissive at the resonant frequency and reflective at frequencies sufficiently removed from resonance. Rootsey also discusses another alternative, where the metal-dielectric patterns are reversed. For example, an array of cross holes may be cut into a metal plate and then mounted onto a dielectric substrate. According to Rootsey, the cross holes are resonant at certain frequencies such that the antenna is transparent at those frequencies. The Rootsey patent defines resonant elements comprising apertures in a conductive surface and producing frequency selective energy transmission. The Rootsey patent may be applicable to any range of frequencies, more particularly it will function in the L-band, Ku-band and Ka-band. While Rootsey discloses an antenna element consisting of resonant holes, a dual antenna system comprising a transmissive surface antenna and a reflective surface antenna is not disclosed.

In U.S. Pat. No. 5,982,339, Lalezari discloses an antenna system consisting of a primary antenna and a secondary antenna. Lalezari teaches a primary antenna having a frequency selective surface portion for transmitting a first frequency and being predominantly transmissive to a second frequency. The second antenna element, taught by Lalezari, transmits a second frequency while the FSS of the second antenna element is transparent to the first frequency. However, Lalezari requires that the resonant element of the primary antenna form a continuous path of metalized segments and the configuration does not correspond to a bandpass/band-reject pair of antennas as proposed here. Instead, the structure has two band-pass surfaces tuned to different frequencies. Non-interconnected elements will have a band pass or band-reject at harmonics of a single frequency. Interconnected elements will result in multiple fundamental frequencies with their associated harmonics. The non-interconnected elements thus provide improved discrimination. Lalezari does not teach the use of non-interconnected resonant elements as an FSS which may be tuned according to the frequency required.

In view of the above, the present invention provides a dual antenna system utilizing frequency selective surfaces having non-interconnected resonator elements and resonant openings, respectively. The present invention further provides a first antenna element which reflects a first frequency while being transparent to a second frequency. The second antenna element, provides the reverse, and reflects the second frequency.

SUMMARY OF THE INVENTION

The present invention provides a dual antenna system where a first antenna element has a metallic surface with openings that are resonant at frequencies other than the operating frequency of a second antenna element. The openings are sized such that the metallic components are relatively transparent at and near resonant frequencies of those openings. According to the present invention, the resonant frequencies of the openings may be the transmitting or receiving frequencies of the second antenna element, or of nearby antennas.

In a broad aspect, the present invention seeks to provide a complementary dual antenna system comprising:

- a first antenna comprising at least one first element on a structure for transmitting and receiving signals within a first frequency band;
- a second antenna comprising at least one second element spaced apart from said at least one first element on the structure for transmitting and receiving signals within a second frequency band;
- said first antenna having a first frequency selective surface, said first frequency selective surface having a resonant grid pattern formed by the said at least one first element, wherein each of said at least one first element is tuned such that the first element is resonant and transparent at a frequency within said first frequency band and reflective at a frequency within said second fluency band; and
- said second antenna having a second frequency selective surface, and said second frequency selective surface formed by said at least one second element, said at least one second element each comprising a resonant opening tuned such that the said resonant opening is resonant and transparent at a frequency within said second frequency band and reflective at a frequency within said first frequency band.

Preferably, each of the resonant opening has a length which is optimized to reduce the radar cross-section of the second antenna at a frequency within the first frequency band.

Preferably, the separation between each of the resonant openings is optimized to provide a maximum bandwidth to the second frequency band.

Preferably, the second antenna element operates in an L-band frequency range.

Preferably, the resonant elements are rings, cross dipole square hoops, Jerusalem crosses or tripoles.

Preferably, the resonant openings are complementary of the resonant elements.

DETAILED DESCRIPTION

The invention will be described for the purposes of illustration only in connection with certain embodiments; however, it is to be understood that other objects and advantages of the present invention will be made apparent by the following description of the drawings according to the present invention. While the preferred embodiment is disclosed, this is not intended to be limiting. Rather, the general principles set forth herein are considered to be merely illustrative of the scope of the present invention and it is further understood that numerous changes may be made without straying from the scope of the present invention.

Figure 1:
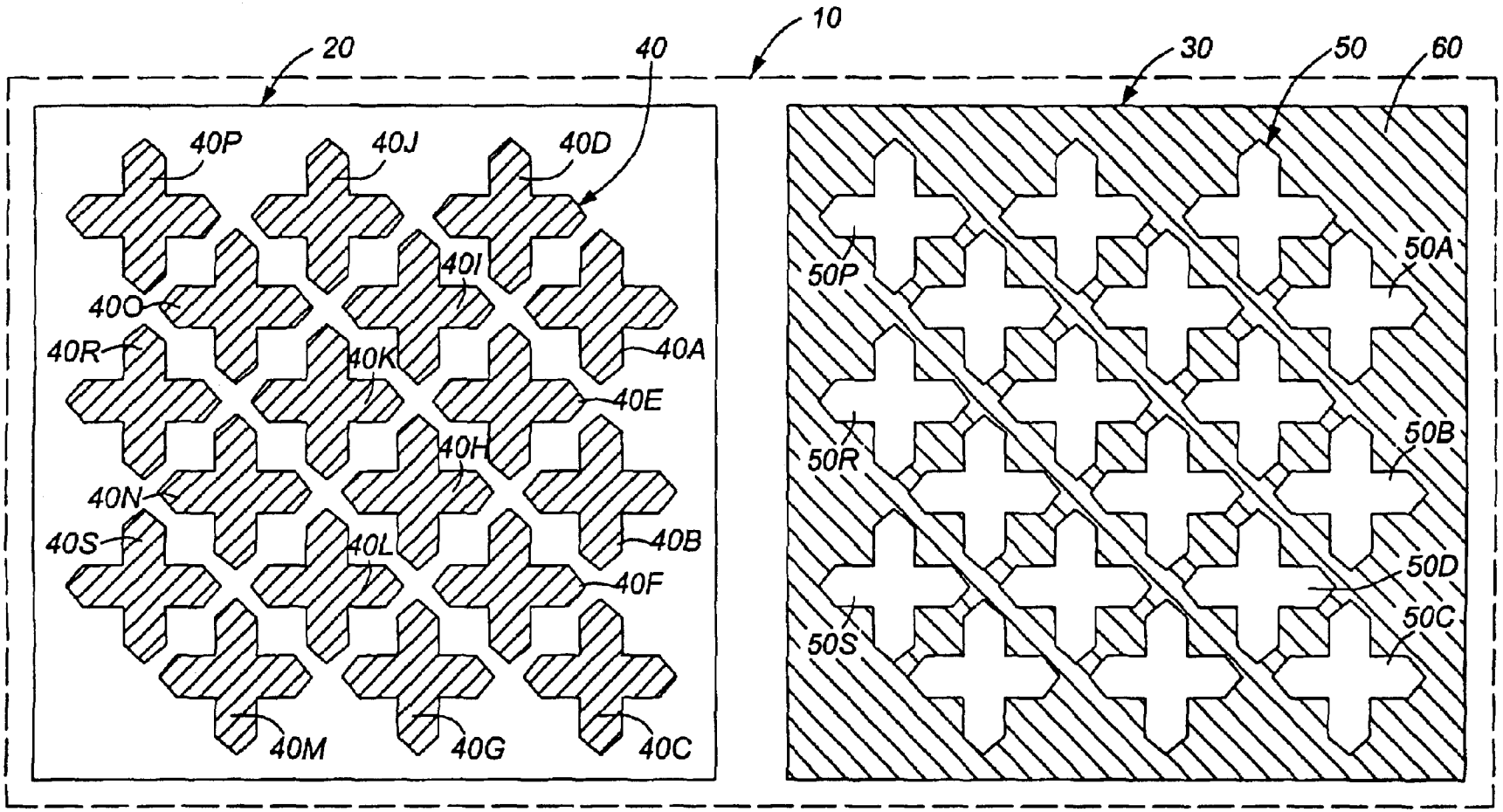
FIG. 1 illustrates the FSS surfaces of a complementary dual antenna system according to the present invention.

The present invention will now be described with reference to the drawings. Referring now to FIG. 1, a complementary dual antenna system 10 is shown according to the present invention. The dual antenna system consists of a first antenna element 20 and a second antenna element 30. The first antenna element 20 has a frequency selective surface (FSS) 40. The FSS 40 is formed of a plurality of frequency selective elements resonant at a first frequency, such as 40A, . . . , 40S. There are various known types of frequency selective elements, also commonly termed resonators. The shapes of these elements include rings, cross dipoles, square loops, Jerusalem Crosses, and tripoles, and they are constructed from metallic elements. In FIG. 1, the FSS 40 is formed from a grid pattern of interlaced resonator crosses 40A, . . . , 40S.

Typically, the resonator crosses 40A, . . . , 40S are sized, within the FSS 40, to resonate at the desired first frequency. The surface of the resonator crosses reject transmission (through the FSS) signals of certain frequencies, by reflecting those signals. The FSS 40 may be called a band-reject surface. The FSS 40 can also be constructed to pass signals of a certain frequency band.

The grid pattern of interlaced resonator crosses 40A, . . . , 40S are formed of an electrically conductive metal layer. The metal used may be a copper, aluminum, gold, or any other conductive metal.

In FIG. 1, the second antenna element 30 has a frequency selective surface 50. The FSS 50 is formed of an interlaced pattern of resonant openings 50A, . . . , 50S. The resonant openings 50A, . . . , 50S allow a band of frequencies to pass through the FSS 50. According to the present invention, the openings may have any shape to allow the openings to resonate at frequencies which are to pass through the FSS 50. The FSS 50 may be called a band-pass surface. The FSS 50 is surrounded by a metallic antenna surface 60.

In addition to selecting their shape, the resonant openings 50A, . . . , 50S are tuned, within the grid structure, to resonate at the desired transmission frequencies. In order to tune the resonant openings, their length must be optimized such that the radar cross-section or reflection ability of the second antenna element 30 is minimized at the frequency of the first antenna element 20, or of any other nearby antenna. Furthermore, the separation between resonant elements provides a maximum bandwidth between resonant openings within the band-pass bandwidth of the FSS 50.

The U.S. Pat. No. 6,407,716 filed Apr. 19, 2001, titled Broadband Dichroic Surface, by Strickland et al., discloses a method of constructing a frequency select surface, which is incorporated herein by reference. The present invention may utilize methods of decal construction, as taught in the US patent to provide both the first and second antenna element.

Figure 2:
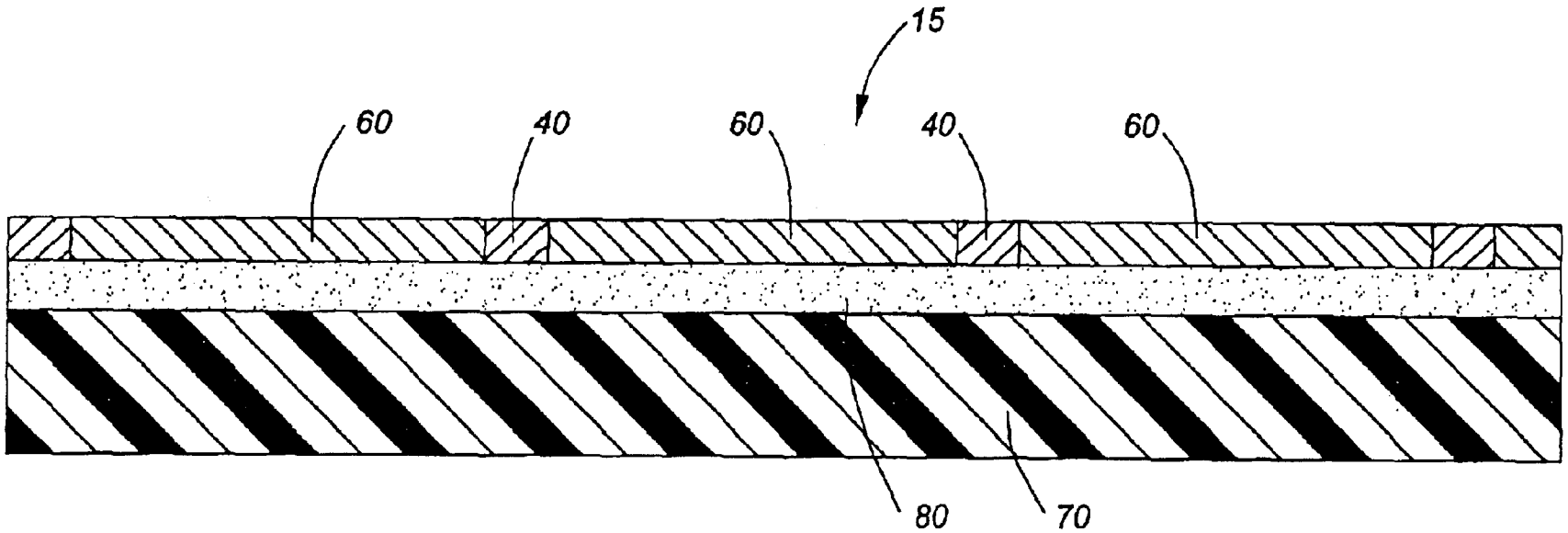
FIG. 2 is a side view of a resonator construction of the complementary dual antenna system of FIG. 1 according to the present invention.
Figure 3:
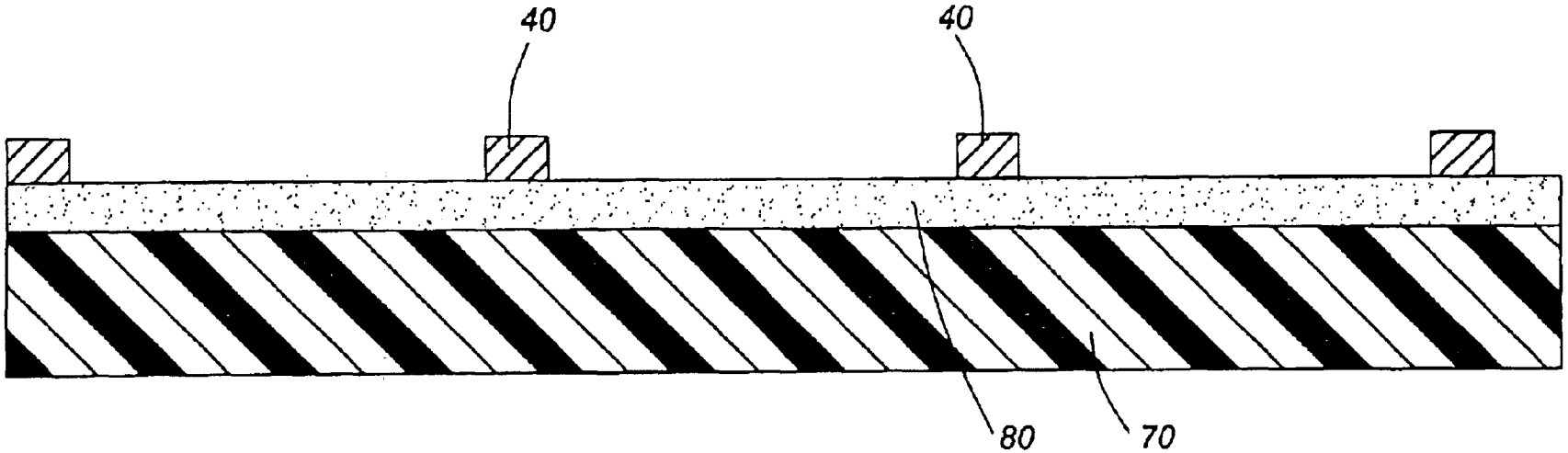
FIG. 3 is a side sectional view of a first antenna element having resonant elements forming part of the complementary dual antenna system of FIG. 1.

In FIG. 2, a side view of a dual antenna system 10 as a decal construction 15 is illustrated. A single decal construction may be utilized to construct both a first antenna element 20 and a second antenna element 30. In an alternative embodiment, each of the antenna elements 20,30 may be made from independent or different size decals. The resonator elements of FSS 40 are shown as being juxtaposed to the metallic surface 60 of the second antenna element 50. In FIG. 2, both the FSS 40 of the first antenna element and the metallic surface are positioned on a first support structure 70 by an adhesive layer 80. In order to provide a second antenna element, a second support structure, shown in FIG. 4, would be required. The resonator elements of FSS 40 would remain on the support structure 70, whereas the metallic surface 60 would be removed to provide the first antenna element 20, as shown in FIG. 3. The use of an adhesive layer 80 facilitates the positioning of the resonator elements 40A, . . . , 40S on a parabolic reflector, for example.

FIG. 3 illustrates a side sectional view of the first antenna element 20 constructed using a decal method, as taught in the aforesaid US patent. In FIG. 3, the resonant elements 40A, . . . , 40S (not all shown) are adhered to first support structure 70 through use of adhesive layer 80.

Figure 4:
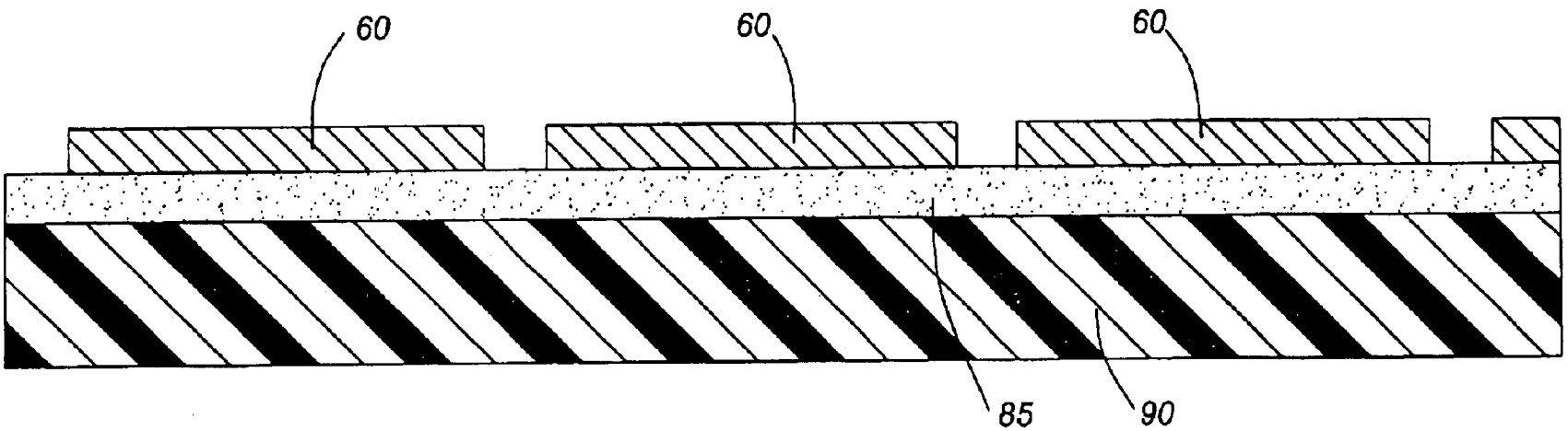
FIG. 4 is a side sectional view of a second antenna element having resonant openings forming part of the complementary dual antenna system of FIG. 1.

FIG. 4 illustrates a side sectional view of the second antenna element 30 constructed according to the decal method. In FIG. 4, the metallic surface 60 is positioned on the second support structure 90 to form the second antenna element 30. An adhesive layer 85 is utilized to adhere the metallic surface 50 to the second support structure.

Although FIGS. 1 through 4 illustrate the use of a flat antenna, a parabolic reflector may be a support structure for one or both antenna elements of the present invention.

It should be understood that the preferred embodiments mentioned here are merely illustrative of the present invention. Numerous variations in design and use of the present invention may be contemplated in view of the following claims without straying from the intended scope and field of invention herein disclosed.

What is claimed is:

1. A complimentary dual antenna system comprising:

a first antenna comprising at least one first element on a structure for transmitting and receiving signals within a first frequency band;

a second antenna comprising at last one second element spaced apart from said at least one first element on the structure for transmitting and receiving signals within a second frequency band;

said first antenna having a first frequency selective surface, said first frequency selective space having a resonant grid pattern formed by the said at least one first element, wherein each of said at least one first element is tuned such that the first element is resonant and transparent at a frequency within said first frequency band and reflective at a frequency within said second frequency band; and said second antenna having a second frequency selective surface, said second frequency selective surface formed by said at last one second element, said at least one second element each comprising a resonant opening tuned such that the said resonant opening is resonant and transparent at a frequency within said second frequency band and reflective at a frequency within said first frequency band.

2. The complementary dual antenna system as in claim 1, wherein each of the resonant openings have a length which is optimized to reduce the radar cross-section of said second antenna at a frequency within said first frequency band.

3. The complementary dual antenna system as in claim 1, wherein a separation between each of the resonant openings is optimized to provide a maximum bandwidth to said second frequency band.

4. The complementary dual antenna system as in claim 1, wherein said second frequency band is the L-band frequency range.

5. The complementary dual antenna system as in claim 1, wherein said resonator elements are selected from the group consisting of rings, cross dipoles, square loops, Jerusalem Crosses and tripoles.

6. The complementary dual antenna system as in claim 1, wherein said complementary dual antenna system is constructed as a decal.

7. The complementary dual antenna system as in claim 1, wherein said plurality of resonant openings are complementary to said resonant dements.

* * * * *